US008800252B2

(12) United States Patent
Vodonos et al.

(10) Patent No.: US 8,800,252 B2
(45) Date of Patent: Aug. 12, 2014

(54) METHOD FOR SECURELY SEATING A CURVILINEAR SURFACED CLOSURE ONTO A CONTAINER

(75) Inventors: Dmitry Yefimovich Vodonos, Madison, CT (US); Dmitry Dmitrievich Vodonos, Madison, CT (US)

(73) Assignee: Conopco, Inc., Englewood Cliffs, NJ (US)

( * ) Notice: Subject to any disclaimer, the term of this patent is extended or adjusted under 35 U.S.C. 154(b) by 27 days.

(21) Appl. No.: 13/122,752

(22) PCT Filed: Mar. 22, 2010

(86) PCT No.: PCT/US2010/028085

§ 371 (c)(1),
(2), (4) Date: Apr. 6, 2011

(87) PCT Pub. No.: WO2011/119139

PCT Pub. Date: Sep. 29, 2011

(65) Prior Publication Data

US 2013/0000096 A1 Jan. 3, 2013

(51) Int. Cl.

| | |
|---|---|
| ***B67B 3/22*** | (2006.01) |
| ***B65B 7/28*** | (2006.01) |
| ***B65B 51/18*** | (2006.01) |

(52) U.S. Cl.

CPC ..... *B67B 3/22* (2013.01); *B65B 7/2842* (2013.01); *B65B 51/18* (2013.01)

USPC ..... 53/485; 53/315; 53/316; 53/329; 100/154

(58) Field of Classification Search

CPC ..... B67B 3/00; B67B 3/22; B65B 51/18; B65B 7/28; B65B 7/2842; B65B 7/285; B65B 7/2857

USPC ..... 53/476, 484, 485, 287, 313, 314, 315, 53/316, 329, 333; 100/151, 153, 154

IPC ..... B67B 3/22; B65B 7/28,51/18

See application file for complete search history.

(56) References Cited

U.S. PATENT DOCUMENTS

| | | | | |
|---|---|---|---|---|
| 2,256,415 A | | 9/1941 | Stewart | |
| 2,319,213 A | * | 5/1943 | Davies | 100/154 |

(Continued)

FOREIGN PATENT DOCUMENTS

| | | | | |
|---|---|---|---|---|
| GB | 547227 | | 8/1942 | |
| GB | 2156792 A | * | 10/1985 | B67B 3/20 |
| JP | 06092307 A | * | 4/1994 | B65B 7/28 |

OTHER PUBLICATIONS

International Search Report PCT/US2010/028085 mailed Dec. 17, 2010, 4 pages.

*Primary Examiner* — Stephen F Gerrity
(74) *Attorney, Agent, or Firm* — Alan A. Bornstein

(57) ABSTRACT

A method and capping apparatus is provided for securely seating a closure with curvilinear top surface onto a container in a manner that avoids damage from excessive force applied to the closure. The apparatus has a cap locking unit with a circulating compression belt that contacts a top surface of the closure/container as the combination is being transported from underneath by a conveyor. A dancer contacts an inner surface of the compression belt. Pressure is applied from the dancer through leading and trailing leg components that converge from a common pivot. Ends of the leading and trailing legs are spaced from one another less than the length of the closure. Force is applied to the closure by simultaneous pressure from both legs on different first and second areas of the closure top surface.

6 Claims, 3 Drawing Sheets

(56) References Cited

U.S. PATENT DOCUMENTS

| | | | | | |
|---|---|---|---|---|---|
| 2,319,214 | A | * | 5/1943 | Davies | 100/154 |
| 2,669,377 | A | * | 2/1954 | Van Poolen et al. | 53/314 |
| 3,054,234 | A | * | 9/1962 | Stover | 53/315 |
| 3,137,982 | A | * | 6/1964 | Decker et al. | 53/316 |
| 3,274,748 | A | * | 9/1966 | Roberts et al. | 53/315 |
| 3,553,300 | A | * | 1/1971 | Buff | 264/41 |
| 3,907,473 | A | * | 9/1975 | de Mets | 100/153 |
| 4,095,390 | A | | 6/1978 | Knudsen | |
| 5,241,801 | A | | 9/1993 | Nelson | |
| 5,937,616 | A | | 8/1999 | Ray | |

* cited by examiner

METHOD FOR SECURELY SEATING A CURVILINEAR SURFACED CLOSURE ONTO A CONTAINER

BACKGROUND OF THE INVENTION

1. Field of the Invention

This invention concerns a method and apparatus to securely seat non-flat topped closures onto containers, particularly closures that require pressure to be snapped-on to containers.

2. The Related Art

Closures with non-flat top-surfaces are difficult to properly seat onto their containers. Known capping systems apply excessive force to achieve closure securement. Unfortunately, the excessive force may cause damage to the closure and/or container. Especially where similar but different sized closures/containers need to be processed through a common capping apparatus, adjustment of application of forces without using expensive equipment may be difficult to achieve.

Compression belt systems for capping are commercially available. For instance, Kinsley Inc. of Doylestown, Pa. markets custom container handling equipment based on compression belts. These belts are inadequate to handle closures with curvilinear top surfaces; the full pressure of the belt backstopped by a flat rigid plate is applied only to the highest area along the contoured closure top surface. The indiscriminate application of force often damages the closure/container.

U.S. Pat. No. 5,937,616 (Ray) discloses a vial capping machine that includes two rollers and a table supported by a frame. The rollers are rotatably driven by a motor. The table supports a tray of vials in which caps have been set into their openings but not fully inserted. As the tray is inserted into the entrance end of the machine, the first driven roller engages the caps of the vials, partially inserting the caps and driving the tray towards the second roller. The second roller engages the caps of the vials, and fully inserts the caps into the vials, and drives the tray to the exit end of the machine. Technology disclosed herein does not solve the problem of properly and securely seating closures that have curvilinear shaped top surfaces.

SUMMARY OF THE INVENTION

A method is provided for securely seating a closure with curvilinear top surface onto a container in a manner avoiding damage from excessive force applied to the closure in a capping apparatus, the method including:

(i) conveying to a cap locking unit a container with separate closure, the container being supported on a moving conveyor and the closure being insecurely seated on the container;

(ii) contacting the curvilinear top surface of the closure with a circulating compression belt, the compression belt being a component of the cap locking unit; and (iii) applying pressure to the curvilinear top surface of the closure via a dancer, the dancer communicating with an inner surface of the compression belt and including a leading and a trailing leg converging from a common pivot, ends of the leading and trailing legs being distant from one another no longer than a length of the closure.

An apparatus is providing for securely seating a closure with curvilinear top surface onto a container to avoid damage from excessive force applied to the closure in a capping process, the apparatus including:

(i) a circulating compression belt for contacting the curvilinear top surface of the closure; and (ii) a dancer contacting an inner surface of the compression belt, the dancer including leading and trailing legs converging from a common pivot, ends of the leading and trailing legs being distant from one another no longer than a length of the closure.

DESCRIPTION OF THE DRAWING

Further advantages and features of the present invention will become more apparent from consideration of the drawing in which.

DETAILED DESCRIPTION OF THE INVENTION

Now we have devised a method and apparatus which can securely seat closures with curvilinear top surfaces onto containers without causing damage to some of these articles. The method and apparatus has the further benefit over prior systems of reducing excessive friction. This inhibits wear on the loaded components. Also with reduced friction, there is lower energy consumption.

Figure 1:
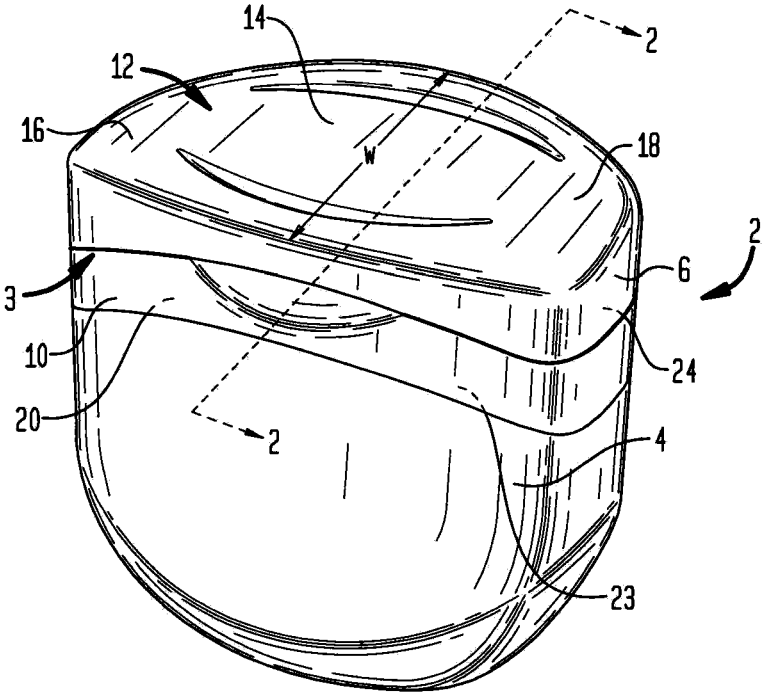
FIG. 1 is a combined closure with container typical for use in the method and apparatus of the present invention.

FIG. 1 illustrates a jar type article typical of those particularly suited to the capping method and apparatus of this invention. The jar 2 features a closure 3 positioned over a container 4. The closure has a cap 6 hingedly connected through a hinge flap 8 to a fitment 10. The cap via the hinge flap can be in an opened or closed position allowing removal from and resealing of contents of the container, respectively. An outer top surface 12 of the cap is curvilinear forming a domed structure. A central area 14 of the top surface is raised relative to flanking first and second areas 16 and 18 of the domed top surface.

Figure 2:
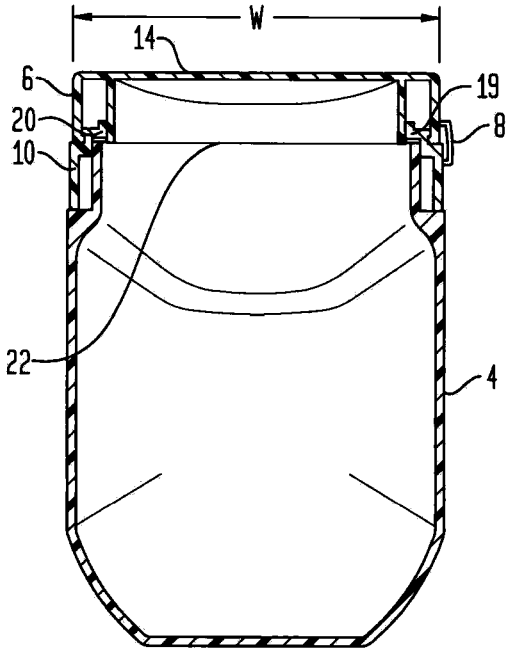
FIG. 2 is a cross-sectional view along lines 2-2 of the embodiment of a closure with container shown in FIG. 1.

Around a mouth 22 of the container as illustrated in FIG. 2 are pairs of nibs. A first pair of nibs 19 and 20 protrudes outward from around the mouth 22. These first pair of nibs are found in a region below the flanking first area. A second pair of nibs 23 and 24 are found each on either side of the mouth 22 and arranged below the flanking second area of the cap surface. Further aspects and features of the closure/container article may be found in WO 2009/109480 and its U.S. and EP equivalent published applications, herein incorporated by reference.

Figure 3:
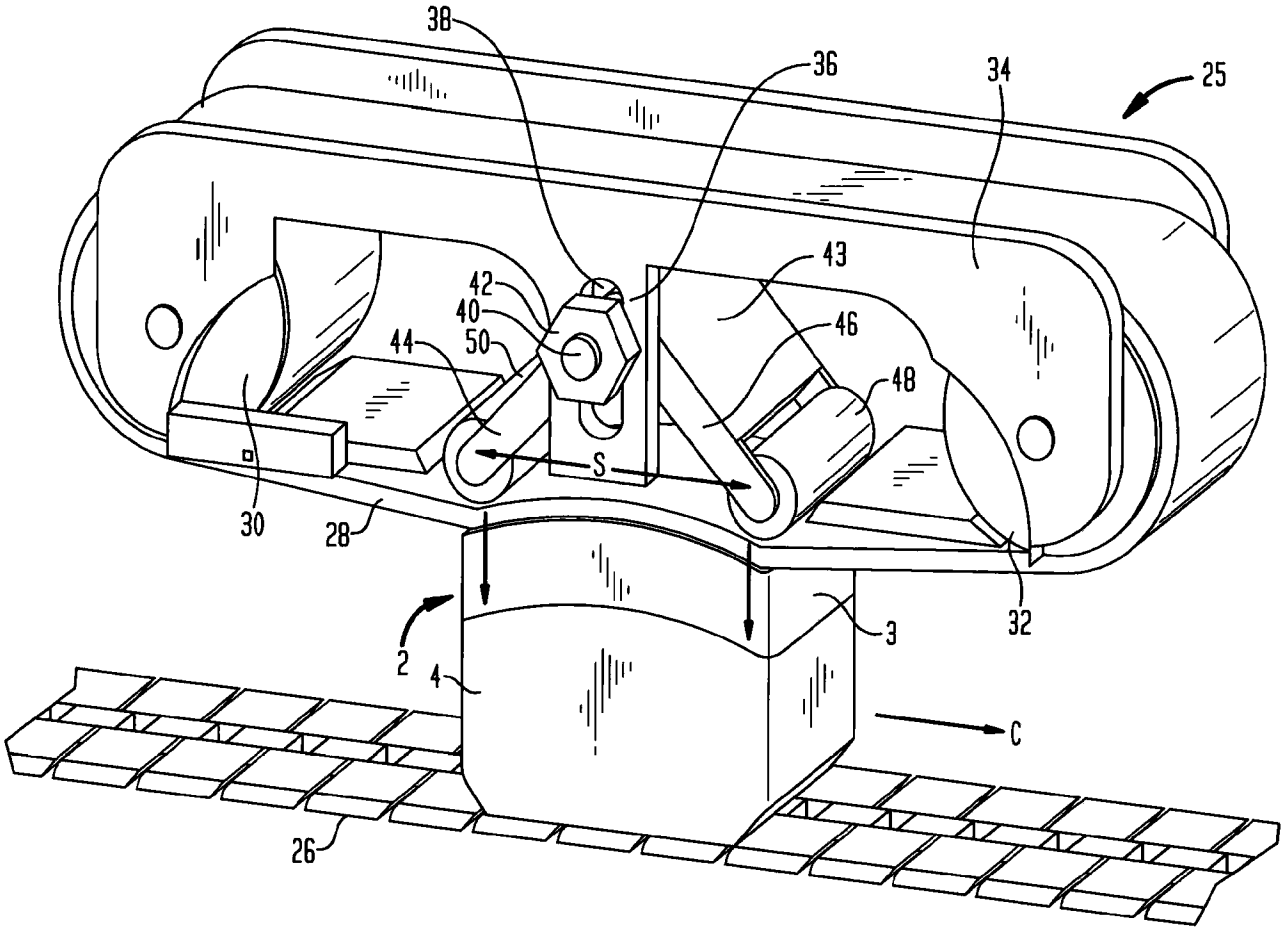
FIG. 3 is a view of the apparatus in a capping operation relative to the closure with container shown in FIG. 1.

FIG. 3 illustrates the cap locking unit 25 of the method and apparatus utilized to secure a closure 3 onto container 4. Conveyor 26 serves as a movable platform for transporting downstream to the cap locking unit the product filled container 4 that has received an insecurely seated closure 3. A continuously circulating compression belt 28 contactingly intersects with the domed outer top surface 12 of the closure.

The compression belt is driven by a driving roller 30 at one end of the cap locking unit and an idler roller 32 at an opposite end.

A support frame 34 commonly supports the driving roller and idler roller. A support bracket 36 projects downward and forms part of the frame 34. A vertically elongated window 38 is formed in the support bracket. Rod 40 traverses through window 38 and is held in position by hexagonal nut 42 or in an alternative embodiment by positioning knob 142. A dancer 43 is supported on rod 40 and includes leading leg 44 and trailing leg 46 oriented away from one another. At an end of the leading and trailing legs and distant from the rod are respective pressure rollers 48 and 50. The leading and trailing legs at a bottom most tangent to the rollers between their midpoints are separated by a length S. Length S ordinarily will be no longer than the longest dimension (in the conveyance direction C) of closure 3.

Figure 4:
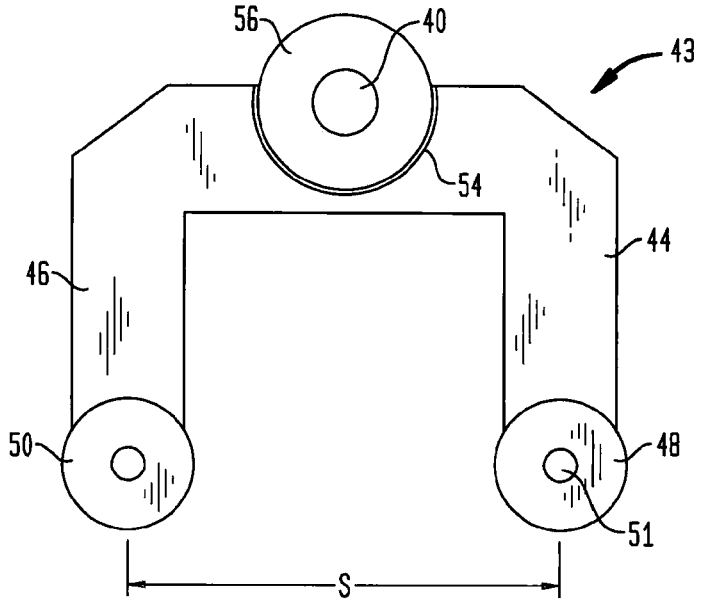
FIG. 4 is a side view of one embodiment of a dancer.
Figure 5:
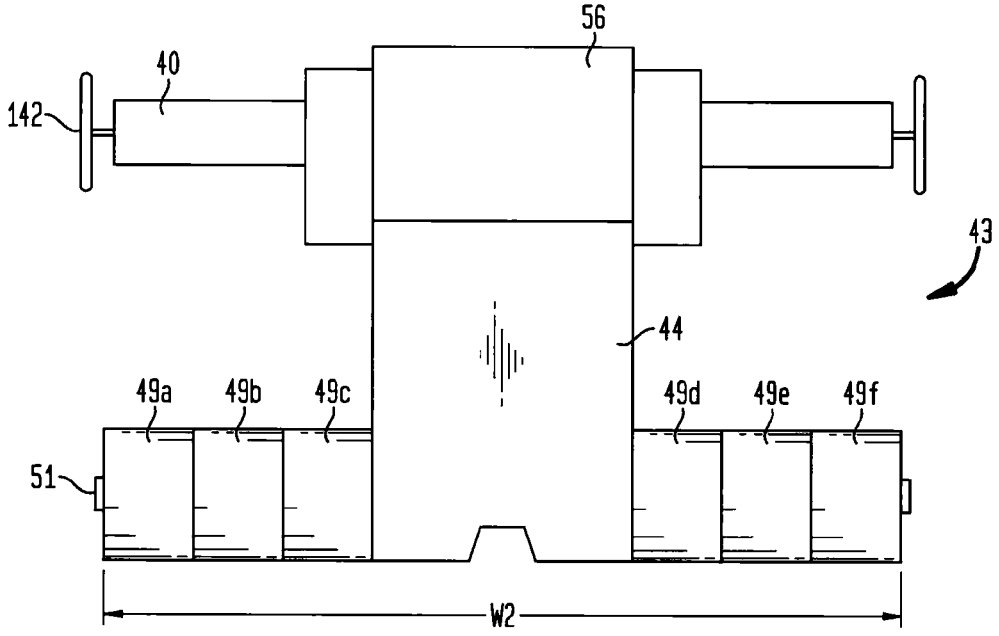
FIG. 5 is a top plan view of the dancer of FIG. 4.

FIGS. 4 and 5 illustrate a slightly different embodiment than shown in FIG. 3 of dancer 43. In this embodiment, legs 44 and 46 are parallel instead of angled toward one another. Pressure roller 48 is formed of a series of three ball-bearings 49*a-f* on either side of leg 44. These are supported on a rod 51. A similar arrangement is found with pressure roller 50.

The dancer 43 shown in FIGS. 4 and 5 possesses a cradle 54 partially receiving ball bearing 56 that surrounds rod 40. The cradle arrangement allows replacement of different sized dancers with different length S between the legs dependent upon the need to cap lock larger or smaller length closures/containers.

Advantageously, the width W2 of the pressure rollers 48 and 50 may be slightly larger than a largest width W of the closure. This width (W2) of the rollers allows processing of different width sized closures/containers.

According to the method, a closure is placed over but not securely seated onto a container. The combination is supported on the conveyor which transports the combination to the cap locking unit. At that point the overhead moving compression belt contacts the top surface of the closure. Next, the leading leg 44 via pressure roller 48 contacts a flanking first area 16 on the closure. This is followed by trailing leg 46 via pressure roller 50 contacting the flanking second area 18 of the domed top surface 12 of the closure. By simultaneous pressure from both the leading and trailing legs onto the domed top surface, the closure is forced downward over the nibs to securely seat on the container.

The compression belt speed is synchronized with the speed of the conveyor. Speeds in some embodiments may range from 50 to 1000 units per minute on closures of 2 to 5 inches in length. It is the pressure rollers of the dancer assembly that navigate the pitches of the closure top surface. Maximum application force is applied only within the short distance S under the dancer arms. This insures selective pressure application. The result is less closure/container breakage, less equipment wear, lower energy use and quick changeability to engage different sized packages.

The method and apparatus also permits capping of different sized snap-on closures and does so in a rapid conversion without necessitating additional equipment. For instance, containers of greater height than a first set of capped containers can be accommodated simply by loosening nut 42 and moving the dancer upward in the supporting bracket 36 within the elongate window 38. For closures of greater length, the dancer may be replaced for one with a greater length S between the legs. Thus, closures/containers of larger height and length dimensions can be capped with minimum time lag conversion of equipment after a different sized closure/container requires a capping operation.

What is claimed is:

1. A method for securely seating a closure with curvilinear top surface onto a container in a manner avoiding damage from excessive force applied to the closure in a capping apparatus, the method comprising:

(i) conveying to a cap locking unit a container with separate closure, the container being supported on a moving conveyor and the closure being insecurely seated on the container;

(ii) contacting the curvilinear top surface of the closure with a circulating compression belt, the compression belt being a component of the cap locking unit; and (iii) applying pressure to the curvilinear top surface of the closure via a dancer, the dancer communicating with an inner surface of the compression belt and comprising a leading and a trailing leg converging from a common pivot, ends of the leading and trailing legs being distant from one another no longer than a length of the closure.

2. The method according to claim 1 wherein the top surface of the closure is a domed surface.

3. The method according to claim 2 wherein the domed surface has a central area higher than flanking first and second areas.

4. The method according to claim 1 wherein the container has a first and second pair of nibs arranged along a periphery of a mouth.

5. The method according to claim 4 wherein the step of applying pressure to the curvilinear top surface forces the first and second pair of nibs to engage the closure to securely seat closure onto container.

6. The method according to claim 1 wherein the leading and trailing legs contact a face of the compression belt, the compression belt separating the leading and trailing legs from the top surface of the closure.

* * * * *